US012426655B1

(12) United States Patent
Russell

(10) Patent No.: US 12,426,655 B1
(45) Date of Patent: Sep. 30, 2025

(54) HATS, INTERCHANGEABLE DECORATIVE CORDS AND METHOD OF INVISIBLY ATTACHING SAME

(71) Applicant: Robert C. Russell, Northbrook, IL (US)

(72) Inventor: Robert C. Russell, Northbrook, IL (US)

( * ) Notice: Subject to any disclaimer, the term of this patent is extended or adjusted under 35 U.S.C. 154(b) by 0 days.

(21) Appl. No.: 19/032,678

(22) Filed: Jan. 21, 2025

Related U.S. Application Data

(60) Provisional application No. 63/624,127, filed on Jan. 23, 2024.

(51) Int. Cl.
*A42B 1/004* (2021.01)

(52) U.S. Cl.
CPC ..... *A42B 1/004* (2013.01)

(58) Field of Classification Search
CPC ..... A42B 1/205; A42B 1/004; A42B 1/0189; A42B 7/00; A42B 1/24; A42B 1/045; A42C 5/00
See application file for complete search history.

(56) References Cited

U.S. PATENT DOCUMENTS 2,121,973 A * 6/1938 Lipton ..... A42B 7/00 132/58
2,838,868 A * 6/1958 Young ..... A01K 97/06 43/57.2
5,367,713 A 11/1994 McCallum
5,450,629 A 9/1995 Gilstrap
5,584,076 A 12/1996 Armstrong
6,647,553 B2 11/2003 Hoyez
6,935,742 B1 * 8/2005 Wilson, Sr. ..... G02C 3/02 351/158
D715,032 S 10/2014 Jones
9,554,612 B2 * 1/2017 Hickey ..... A42B 1/0182
11,882,895 B2 1/2024 Bryan et al.
12,310,442 B1 * 5/2025 Carre ..... A42B 1/205
(Continued)

FOREIGN PATENT DOCUMENTS

CN 103960808 A 8/2014
CN 112789233 A 5/2021
(Continued)

OTHER PUBLICATIONS

Badge Holder Elastic Cords. Accessed Dec. 22, 2023. https://www.nametag.com/lanyards/neck-cords/elastic-cord.php.

*Primary Examiner* — Haley A Smith
(74) *Attorney, Agent, or Firm* — LESLEY A. WALLERSTEIN, LLC

(57) ABSTRACT

A hat has upper crown variations, circumferential lower crown variations, an interior surface of the upper and lower crown, an exterior surface of the upper and lower crown, a sweatband attached to substantially the entire circumference of the lower crown, forming a sweatband-lower crown seamline, brim variations, and a pair of holes in the sweatband-lower crown seamline. Decorative interchangeable cords each have two opposing ends and foldable rigid barbs capping each end. Each end of the decorative corresponds to and inserts into one hole in the sweatband-lower crown seamline, invisibly attaching the cord to the hat.

5 Claims, 7 Drawing Sheets

(56) References Cited

U.S. PATENT DOCUMENTS

| | | | | |
|---|---|---|---|---|
| 2009/0175482 | A1* | 7/2009 | Crutcher | H04R 1/1033 381/376 |
| 2012/0030860 | A1 | 2/2012 | Lovitz | |
| 2015/0150328 | A1* | 6/2015 | Knight | A42C 5/04 2/175.1 |
| 2017/0202294 | A1* | 7/2017 | Hickey | A42B 7/00 |
| 2017/0258165 | A1 | 9/2017 | Thornton | |
| 2020/0214382 | A1* | 7/2020 | Dann | A42B 1/225 |
| 2021/0259345 | A1 | 8/2021 | Michaels | |
| 2022/0330643 | A1 | 10/2022 | New | |

FOREIGN PATENT DOCUMENTS

| | | | |
|---|---|---|---|
| KR | 880004036 | A | 6/1988 |
| KR | 20060092812 | A | 8/2006 |
| KR | 20100008342 | U | 1/2010 |

* cited by examiner

HATS, INTERCHANGEABLE DECORATIVE CORDS AND METHOD OF INVISIBLY ATTACHING SAME

CROSS-REFERENCE TO RELATED APPLICATIONS

This application claims the benefit of U.S. Provisional Patent Application 63/624,127, filed Jan. 23, 2024.

STATEMENT OF GOVERNMENT INTEREST

Not Applicable.

JOINT RESEARCH AGREEMENT

Not Applicable.

SUMMARY OF THE INVENTION

A hat has upper crown variations, circumferential lower crown variations, an interior surface of the upper and lower crown, an exterior surface of the upper and lower crown, a sweatband attached to substantially the entire circumference of the lower crown, forming a sweatband-lower crown seamline, brim variations, and a pair of holes in the sweatband-lower crown seamline. At least one decorative interchangeable cord has two opposing ends, foldable rigid barbs capping each end. Each end corresponds to one hole in the sweatband-lower crown seamline. The folded barb has a smaller diameter than its corresponding hole. The unfolded barb has a larger diameter than its corresponding hole. The decorative interchangeable cord may have a round cross section like a rope, or a flat cross section like a ribbon. The cord may be a textile, thermoplastic or nonwoven material. Inserting the folded barbs from the exterior of the hat into their corresponding holes and unfolding them behind the sweatband-lower crown seamline, into the interior of the hat, invisibly attaches the decorative cord to the hat. The steps are reversed to remove the cord.

FIELD OF THE INVENTION

The invention is directed to hats with crown variations, brim variations, decorative cord variations and ways of interchangeably, yet invisibly, personalizing and customizing the hats with these decorative cords. People decorate hats with colored cords and ribbons for a variety of cultural, social, and personal reasons, which often stem from traditions, expressions of individuality, and a desire to signify achievement. Many schools, sports teams, and businesses have identifying colors.

Another reason people decorate hats with cords and ribbons is to express individuality, fashion sense, and personal style. For many, the hat is not just a uniform part of an outfit, but an opportunity to stand out or showcase personal interests. Customizing a hat with colors, patterns, or embellishments allows individuals to express their unique identities. Whether it's adding a ribbon to match a favorite color or using cords to highlight a special event, these decorations offer a chance to personalize what might otherwise be a simple or standard accessory.

Decorative cords also have symbolic meanings. For example, military personnel or members of specific organizations might decorate hats with these items as a way to show affiliation, rank, or honor. For instance, a military member might wear a ribbon to denote a particular medal or service, while a club or fraternity member might use cords to represent membership or achievements. The use of these decorations thus communicates affiliation and accomplishment, often serving as a mark of pride and solidarity with a group.

Decorating hats can serve as a form of creative expression. Many people enjoy the process of selecting, arranging, and adding cords, ribbons, or other embellishments to their hats, viewing it as an artistic activity. Whether for a graduation ceremony, a festival, or a special event, the decorative process can be an enjoyable, hands-on way for individuals to express their creativity.

In the past, such cords have been permanently attached to the hat. If you wanted a different colored or patterned cord, you would have to remove the stitching or glue, risking damage to either the hat, the cord, or both, or simply buy another hat with the cord you want. To date, no one has created a base hat or hat that permits a variety of cords to be attached and detached, used and re-used without either damaging the cord or the hat in the process. I have created such a system.

REFERENCE NUMERALS

1 Hat with attached decorative cord
10 Hat
20 Cord
30 Barb
40 Sweatband
50 Brim
60 Sweatband-lower crown seamline
70 Hole
80 Lower crown

DETAILED DESCRIPTION OF THE INVENTION

Figure 1:
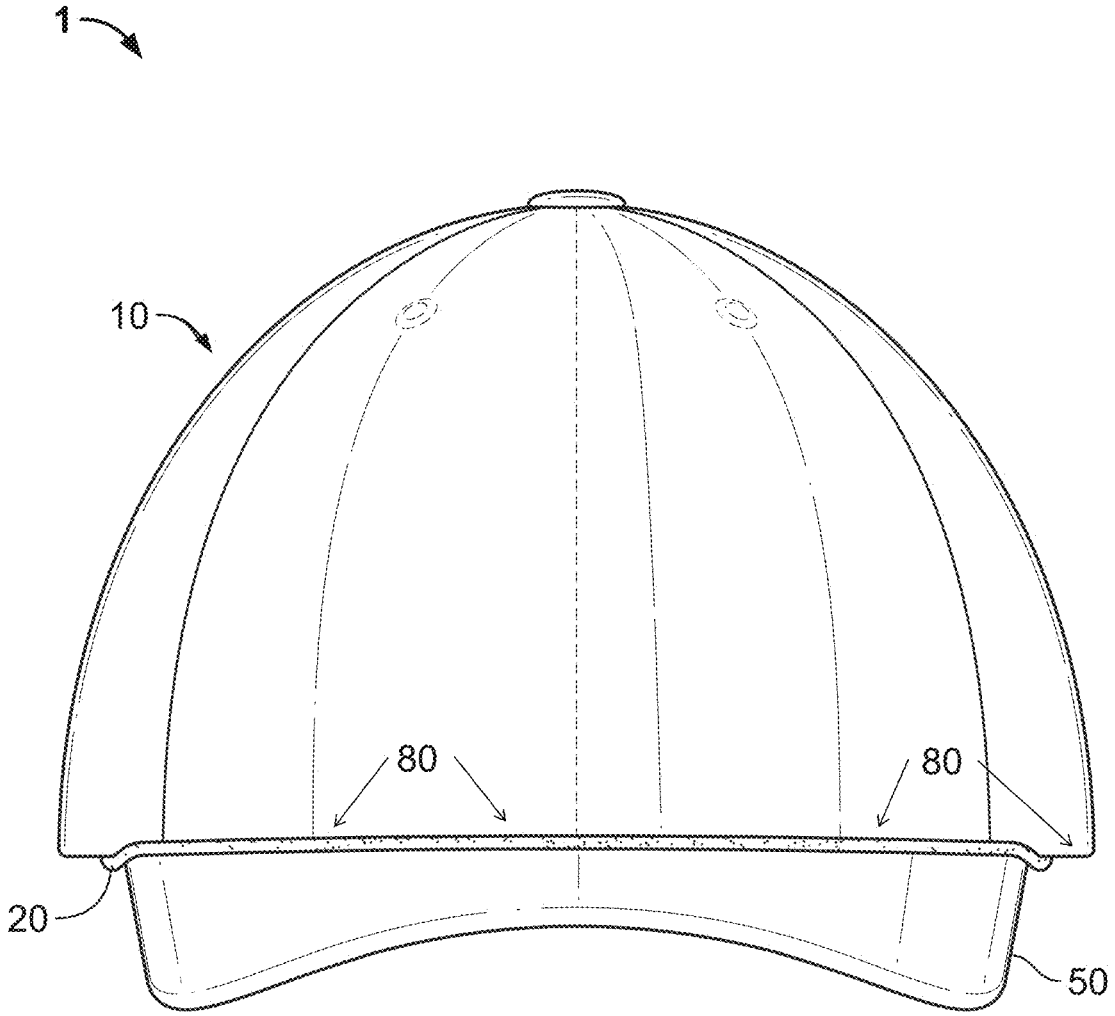
FIG. 1 is a front view of an embodiment of a hat and invisibly attached interchangeable cord.

FIG. 1 is a front view of an embodiment of a hat and invisibly attached interchangeable cord 1. This hat has an upper crown, a lower crown, a brim, and a sweatband. The upper crown and the lower crown have an interior surface, facing a wearer's head, and an exterior surface. This particular embodiment, commonly known as a baseball hat or a trucker's hat, comprises four or more contoured panels seamed together and tapering to a top point. In this embodiment, the upper crown, not numbered, is closed at the top point. Where the panels meet at this top point is marked and secured by a button. The panels may comprise any combination of textile and mesh.

The hat features a lower crown 80, brim 50 and cord 20. Cord 20 lays on the seamline formed by joining brim 50 to lower crown 80. The hat may or may not have ventilation holes in the upper crown. These holes can be finished by sewn eyelets or grommets.

Figure 2:
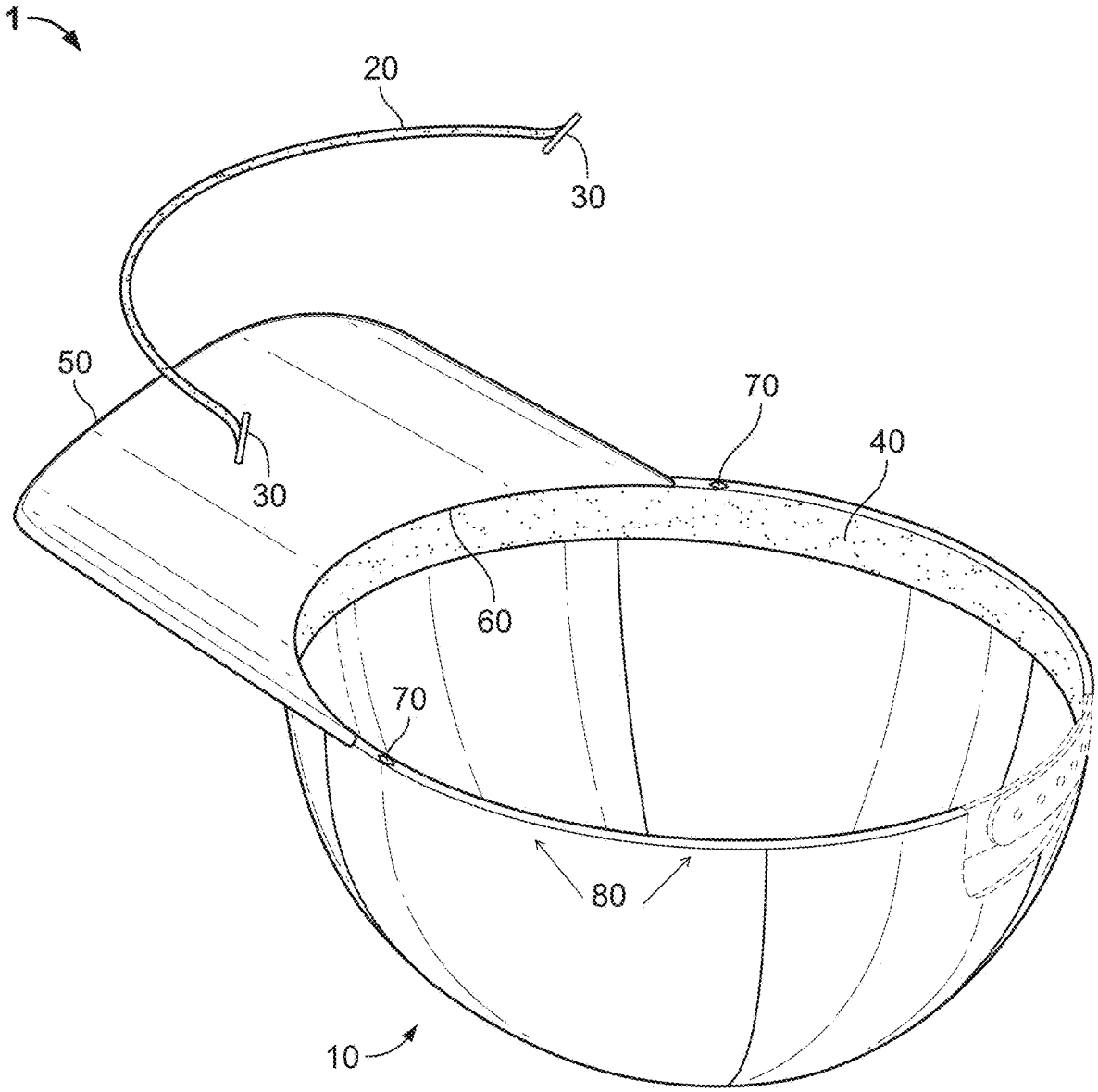
FIG. 2 is a bottom exploded and perspective view thereof, showing the cord detached from the hat.
Figure 5:
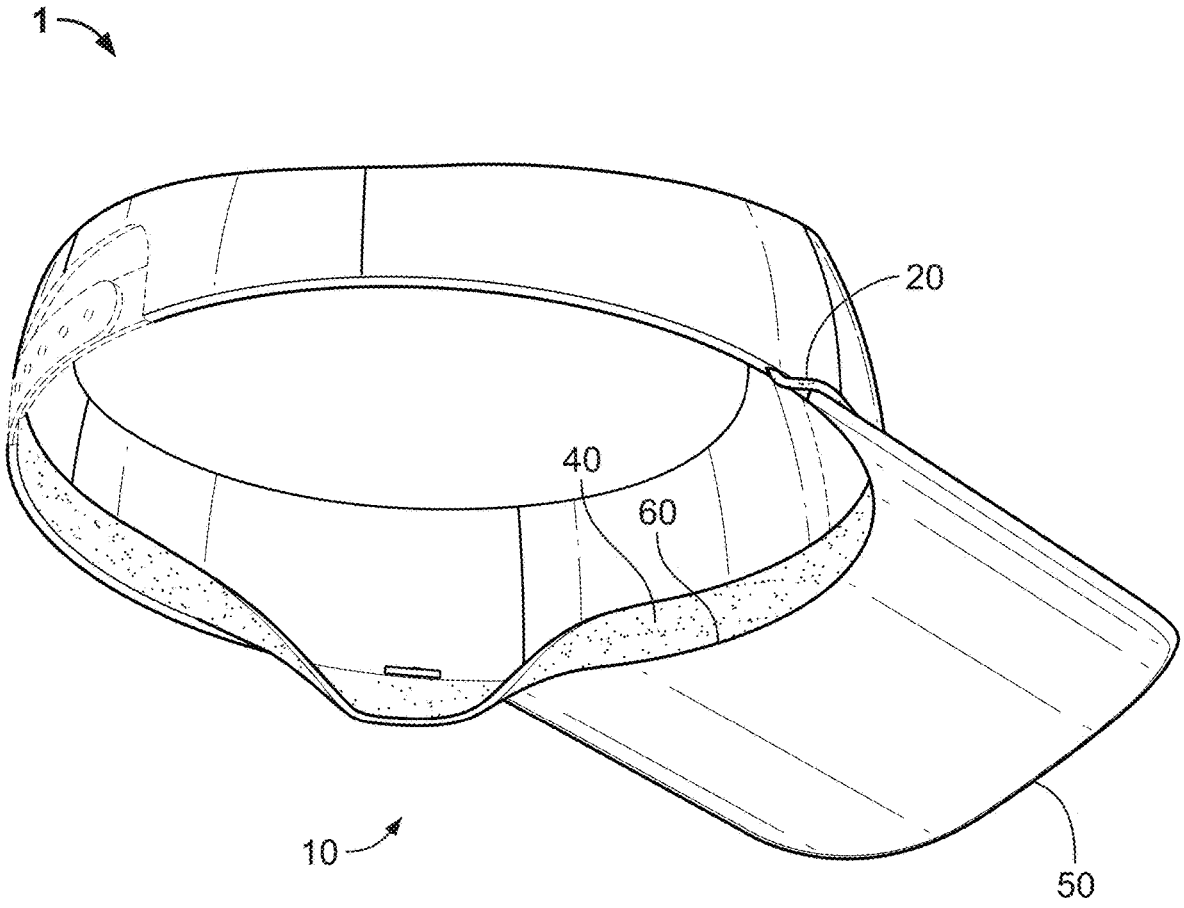
FIG. 5 is a bottom perspective view of a second embodiment of the hat and invisibly attached interchangeable cord.
Figure 6:
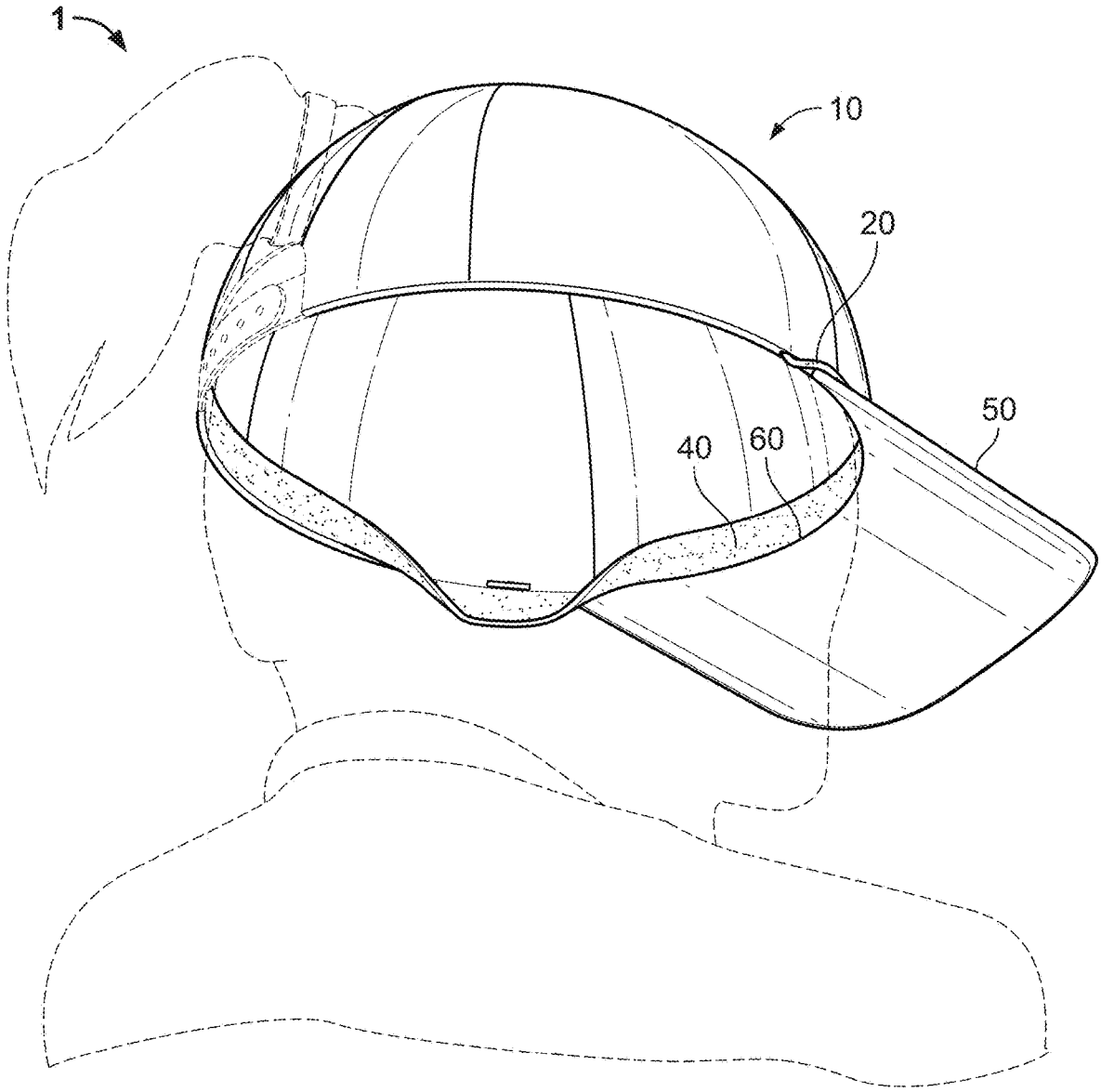
FIG. 6 is a bottom perspective view of a third embodiment of the hat and invisibly attached interchangeable cord.
Figure 7:
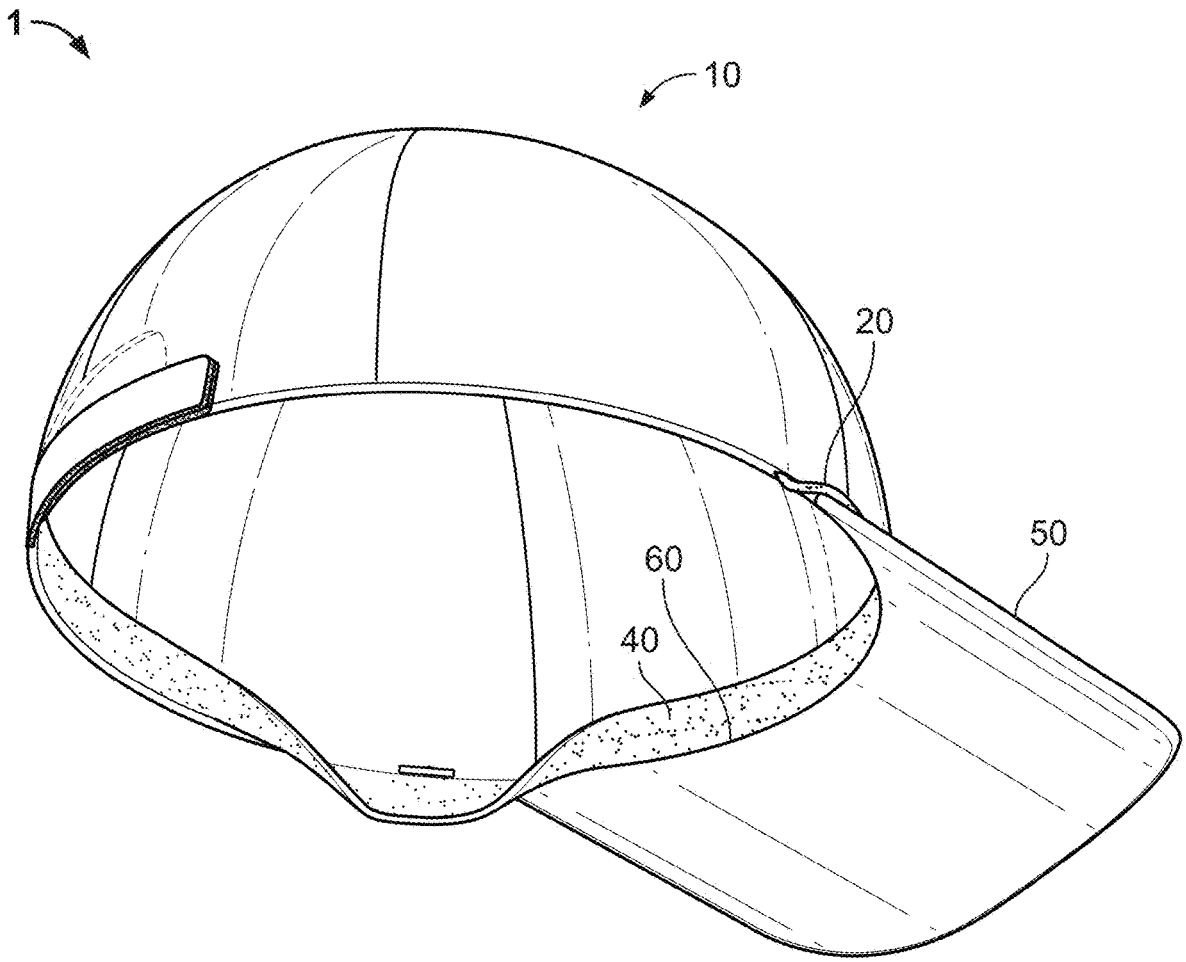
FIG. 7 is a bottom perspective view of a fourth embodiment of the hat and invisibly attached interchangeable cord.

FIG. 2 shows what this baseball/trucker hat looks like flipped upside down and separated from the cord. In this view, lower crown 80 of this specific hat forms a complete circle, except for a rear snapback closure. The system similarly works with other closure and size adjustment variations such as hook and loop tape, D-ring, elastic and buckle, and even if there is no closure. The system works equally well for a hat that has no upper crown and top point, as in the visor shown in FIG. 5. It works in hats with a ponytail hole at the upper crown as shown in FIG. 6. Any hat that has a circumferential lower crown, a sweatband seamed to substantially the entire circumference of the lower crown, and a brim inserted into at least some portion of the sweatband-lower crown seamline will work.

Sweatband 40 attaches to the lower crown except for this snapback closure, substantially the entire circumference of the lower crown. Sweatband 40 is sewn to lower crown 80 to face the interior surface of the lower crown. This forms sweatband-lower crown seamline 60. A baseball/trucker hat such as this typically has a rigid, curved brim 50, also called a bill, which inserts into a front-facing portion of the sweatband-lower crown seamline. Other styles of brim and bill not shown are entirely possible.

We create a pair of spaced-apart holes 70 in the sweatband-lower crown seamline. The holes are specifically spaced apart the length of the cord. Each hole corresponds to one end of the cord. Holes 70 are not visible when the hat is worn. We reinforce and finish the holes with eyelets or an anti-fray chemical. In the embodiment shown, these holes are positioned between the brim and the rear of the hat. Cord 20 has a diameter and two opposing ends. Each of the two opposing ends of the cord are finished and capped with a rigid barb 30. For purposes of this patent application, when we use the word "cord," we mean not only a length of braided material with a circular cross section, but any decorative trim that has a length. Preferably, the cord is 28-31.5 cm long, which corresponds to the width of a typical baseball cap brim. The cord can be a length of braid that those in the industry often call a "rope" or "brim rope." The cord can also be a flat woven material such as twill tape, or grosgrain, satin, or other ribbon, to name a few. It can be a length of nonwoven material, or even thermoplastic such as gimp or lanyard. The drawings here illustrate the use of circular cross section "rope" for nonlimiting illustration purposes.

Regardless of the type of cord, we cap each of its two raw ends with a barb. We do this for two reasons: to protect the ends of the cord from fraying and also to facilitate insertion into holes 70. The barb is a rigid material such as plastic, metal or wood, though other rigid materials are certainly possible. Barbs 30 have a diameter and a length. In an unfolded position, shown in FIG. 2, barbs 30 are perpendicular to the length of the cord 20. In a folded position, barbs 30 are parallel to the length of cord 20. The diameter of barb 30 can vary, but it is critical that when folded against the cord, the combined diameter is smaller than hole 70, and when barb 30 is unfolded to be perpendicular to the cord, the length of the barb is larger than hole 70.

Figure 3:
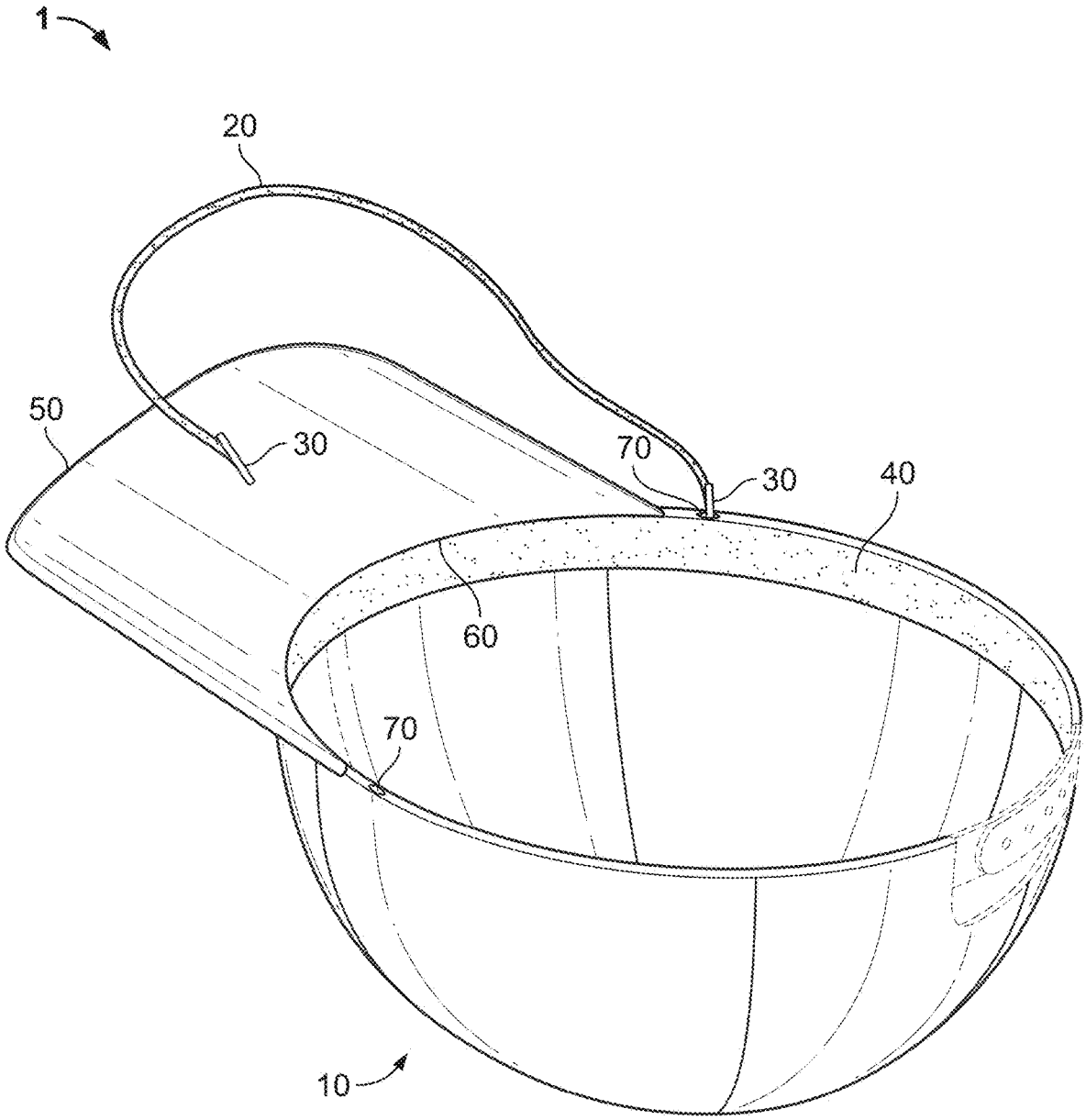
FIG. 3 is an alternative view of FIG. 2, showing the cord being attached to the hat.
Figure 4:
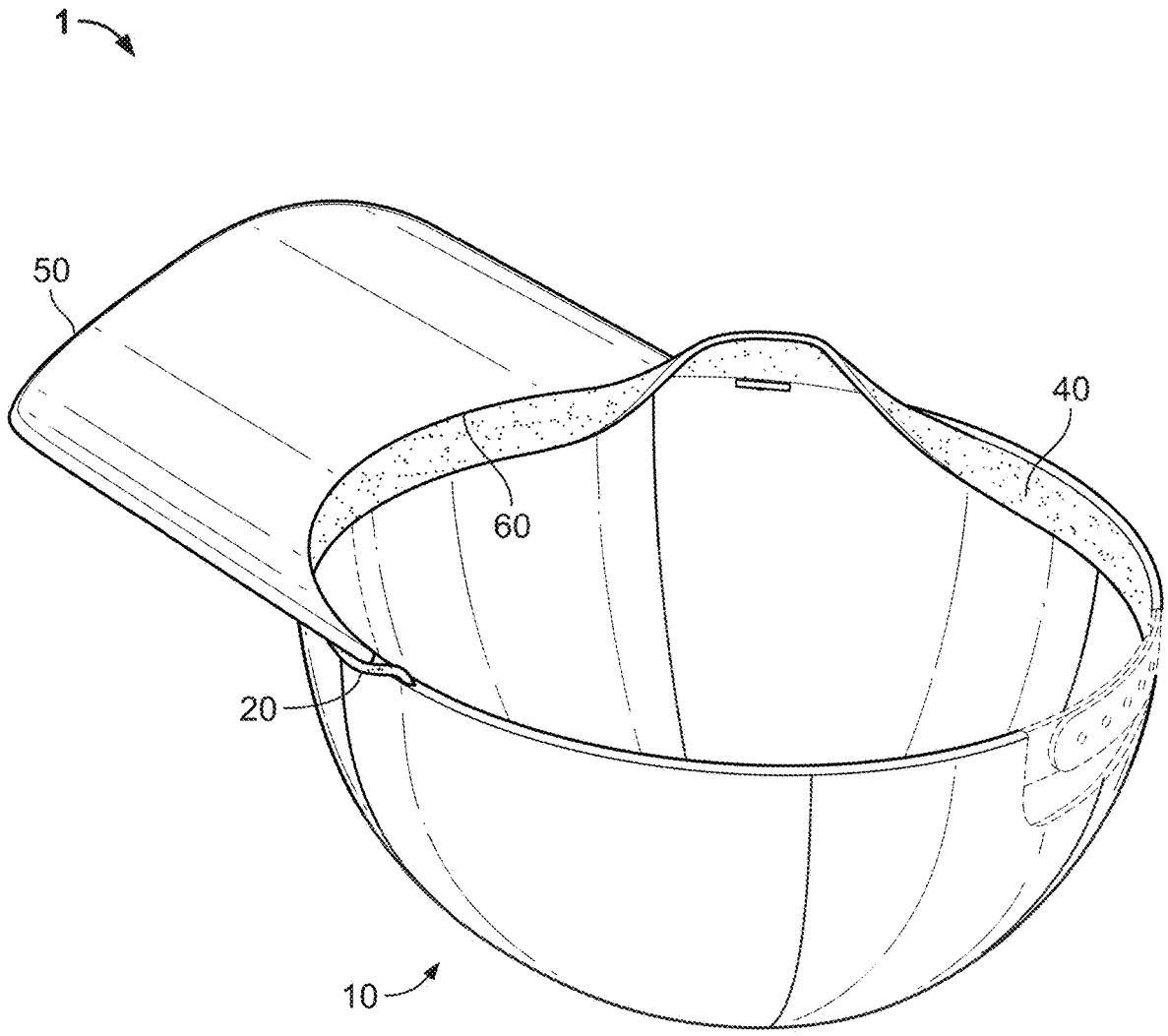
FIG. 4 is a second alternative view of FIG. 2, showing the cord attached to the hat.

These proportions allow a person to insert the barb and cord into the hole, as shown in FIG. 3, then secure it in place, between the sweatband and the interior surface of the lower crown, as shown in FIGS. 4-7. The wearer reverses these steps to remove the cord. Because the barb nestles flat within and parallel to the sweatband-lower crown seamline, it cannot be seen from the outside and cannot be felt by the wearer. Because the length of the barb is larger than hole 70, it cannot come out unless someone intentionally removes it.

Although embodiments and examples of the invention have been shown and described, it is to be understood that various modifications, substitutions, and rearrangements of parts, components, steps, as well as other uses, shapes, construction, and design of this system can be made by those skilled in the art without departing from the novel spirit and scope of this invention.

I claim:

1. A method of invisibly attaching an interchangeable decorative cord to a hat having a circumferential lower crown, an exterior surface of the lower crown, an interior surface of the lower crown, a sweatband attached to substantially the entire circumference of the lower crown, along a sweatband-lower crown seamline, and a brim inserted into the sweatband-lower crown seamline, comprising the steps of:

a. folding rigid barbs fixed to opposing ends of an interchangeable decorative cord against the length of the cord;
b. opening the sweatband, thereby exposing the sweatband-lower crown seamline;
c. inserting, from the exterior surface of the lower crown, each folded rigid barb into a corresponding hole in the sweatband-lower crown seamline, and toward the interior surface of the lower crown;
d. unfolding each rigid barb; and
e. closing the sweatband, thereby enclosing the rigid barb between the sweatband and the interior surface of the lower crown.

2. A system for invisibly attaching interchangeable decorative cords to a to a hat, comprising:

a. a hat with a circumferential lower crown;
b. an exterior surface of the lower crown;
c. an interior surface of the lower crown;
d. a sweatband attached to substantially the entire circumference of the lower crown, thereby creating a sweatband-lower crown seamline;
e. at least one interchangeable decorative cord with a length and with rigid folding barbs fixed to opposing ends of the cord;
f. a pair of holes in the sweatband-lower crown seamline, these holes spaced apart the length of the interchangeable decorative cord; and
g. a brim inserted in the sweatband-lower crown seamline.

3. The system of claim 2, wherein the hat also has an upper crown.

4. The system of claim 2, wherein the hat has a back closure.

5. The system of claim 4, wherein the back closure is selected from the group consisting of snapback, hook and loop tape, buckle and elastic.

* * * * *